US006552307B2

(12) United States Patent
Schilling et al.

(10) Patent No.: US 6,552,307 B2
(45) Date of Patent: Apr. 22, 2003

(54) TEMPERATURE DETECTION DEVICE FOR AN ELECTRIC RADIANT HEATER

(75) Inventors: Wilfried Schilling, Kraichtal (DE); Oliver Gremm, Kuernbach (DE); Wilhelm Perrin, Karlsruhe (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 09/905,534

(22) Filed: Jul. 13, 2001

(65) Prior Publication Data

US 2002/0011480 A1 Jan. 31, 2002

(30) Foreign Application Priority Data

Jul. 22, 2000 (DE) ..... 100 35 745

(51) Int. Cl.[7] ..... H05B 3/68
(52) U.S. Cl. ..... 219/448.11; 219/447.1
(58) Field of Search ..... 219/446.1, 447.1, 219/448.11, 448.13, 448.14, 448.16, 448.17, 448.18, 448.19, 460.1, 461.1, 518

(56) References Cited

U.S. PATENT DOCUMENTS 5,136,277 A * 8/1992 Civanelli et al. ..... 219/445.1
5,424,512 A * 6/1995 Turetta et al. ..... 219/447.1
5,893,996 A * 4/1999 Gross et al. ..... 219/447.1
6,184,501 B1 * 2/2001 Zapf ..... 219/447.1

FOREIGN PATENT DOCUMENTS

| | | |
|---|---|---|
| DE | 195 26 091 | 1/1997 |
| DE | 196 03 845 | 8/1997 |
| DE | 198 13 996 | 10/1999 |

* cited by examiner

*Primary Examiner*—Sang Paik
(74) *Attorney, Agent, or Firm*—Akerman Senterfitt

(57) ABSTRACT

A description is given of a temperature detection device for an electric radiant heater, with which is associated an active sensor for detecting the positioning of a cooking vessel on a hotplate, particularly a glass ceramic plate, covering the radiant heater. This sensor is part of an inductive resonant circuit of a control means and preferably has a single sensor loop of electrically conductive material located in the vicinity of at least one heating zone heatable by electric radiant elements and preferably partly overlapping the same. According to the invention, with at least one portion the sensor loop forms a functional element of a temperature sensor of the temperature detection device. For example, a tubular sensor loop portion can serve as a supporting or protective jacket of a jacket thermocouple.

30 Claims, 5 Drawing Sheets

TEMPERATURE DETECTION DEVICE FOR AN ELECTRIC RADIANT HEATER

Figure 1:
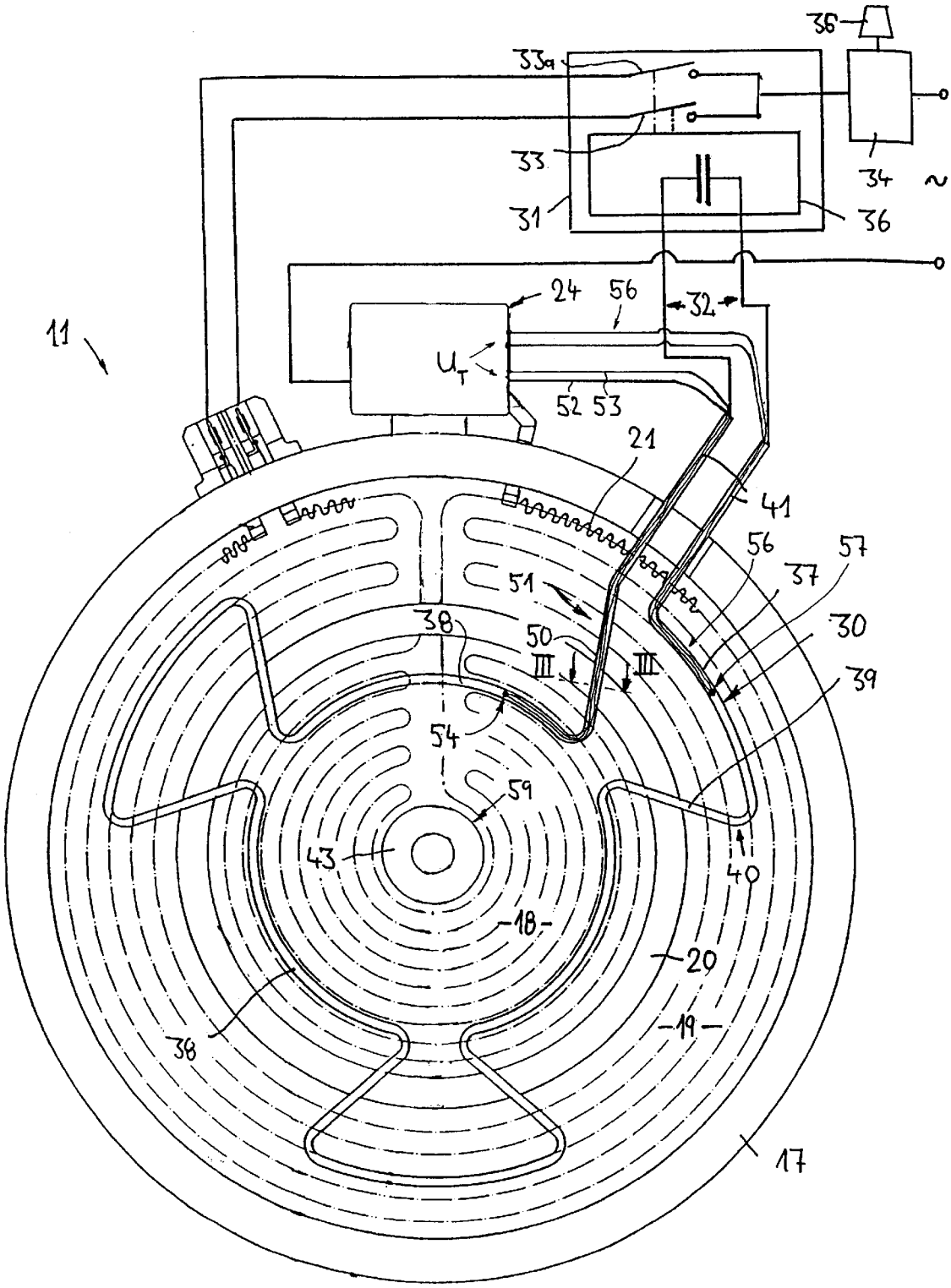

The invention relates to a temperature detection device for an electric radiant heater, with which is associated an active sensor for the detection, of the positioning of a cooking vessel on a hotplate covering the radiant-heater and in particular a glass ceramic plate.

The automatic switching on and off of a cooking point as a direct function of the placing thereon of a cooking vessel or pot has been a long-term aim. The systems proposed for this purpose are based on the most varied principle and usually the nature and arrangement of the sensor for detecting the cooking vessel positioning is decisive. In the inductive systems considered in preferred manner here, the sensor is part of an inductive resonant circuit of a control means, preferably operating by means of resonant circuit tuning, and has at least one sensor loop with electrically conductive material through which an inductance is formed. The sensor loop is positioned in the vicinity of at least one heating zone heatable by electric radiant heating elements in such a way that through a cooking vessel positioned in the vicinity of the heating zone the inductance of the sensor loop is modified in such a way that a connected evaluating device can distinguish between the presence and absence of a set down cooking vessel.

A simple and robustly constructed pot detection system of this type, which supplies particularly significant signals for the control of the radiant heater is disclosed by DE 196 03 845. A temperature detection device for the radiant heater therein comprises a temperature monitor with a rod-like temperature sensor, which acts on a temperature monitor contact for maintaining a permitted material temperature on the underside of the glass ceramic hotplate and on a hot indication contact for indicating the hot state of the heater. The rod sensor projects through an insulator rim laterally bounding the heating zone and passes in a plane above the radiant elements below the sensor loop.

The problem of the invention is to provide a temperature detection device for such radiant heaters, which is particularly simple and inexpensively manufacturable.

This problem is solved by a temperature detection device having the features of claim 1. Preferred further developments are given in the dependent claims, whose wording is by reference made into part of the content of the description.

According to the invention the sensor loop has at least one portion, which is functionally part of a temperature sensor, which emits temperature signals, of the temperature detection device, the temperature signals preferably being electrical and/or are electrically or electronically evaluatable. The presence of a sensor loop for pot detection purposes is consequently utilized in order to ensure an adequately precise temperature detection with the aid of the sensor loop. Use is made of the fact that the sensor loop is generally located in the vicinity of a heating zone and preferably also in the immediate proximity of the hotplate, particularly glass ceramic plate, whose temperature is to be monitored. This favourable positioning of the sensor loop or its portion used for temperature detection purposes makes it possible, particularly in conjunction with appropriately selected electrical and/or structural characteristics of the portion or the sensor loop, to integrate an effective temperature detection device with the pot detection sensor system. Thus, there is no need for separately provided temperature detection devices, such as e.g. the aforementioned rod sensors.

A further development is characterized in that the sensor loop at least partly overlaps the heating zone with at least one overlapping portion and the portion used as the functional part of the temperature detection device is preferably located in the vicinity of the overlapping portion. As a result the portion used for temperature detection purposes is located directly in the radiant area of the radiant elements and preferably spaced from an insulating edge bounding the heating zone. This permits a particularly short delay temperature detection or temperature change detection with optionally only small temperature variations. This arrangement also leads to advantages for the pot detection function, because a pot detection signal provides much more information for the covering of the heating zone as compared with a sensor passing round in the marginal area of the heater and consequently is more significant for pot detection purposes. The relevant explanations in DE 196 03 845 are hereby, by reference, made into part of the present application.

Within the scope of the invention various appropriate use possibilities of the sensor loop exist for temperature detection. For example the situation can be such that the temperature detection device has an electronic device for evaluating electrical temperature signals and that said device is in signal-conducting, electrical connection with the portion of the sensor loop. The portion can here form an electrically active part of the temperature sensor, so that temperature-dependent, electrical characteristics of the portion, optionally in conjunction with the temperature-dependent, electrical characteristics of neighbouring portions, can be used for producing temperature signals.

The situation can e.g. be such that the device for evaluating temperature signals is constructed for detecting and evaluating thermally caused changes in the electrical resistance of the portion, the complete sensor loop or a resistance element carried by the sensor loop, e.g. a resistance wire or a resistive film. For producing very readily evaluatable temperature signals the material, whose resistance is used for temperature detection purposes, is appropriately provided with a high temperature coefficient of the electrical resistance and said temperature coefficient can be both positive (PTC) and negative (NTC).

It is also possible for the sensor loop with at least one loop portion to form part of a temperature sensor functioning as a thermocouple. A connected signal processing is then appropriately provided for the processing of thermoelectric voltages and can assume any appropriate form for this.

The construction of at least one thermocouple with the aid of the sensor loop or one of its portions can take place in different ways. For example, the sensor loop can have a first loop portion of a first electrically conductive material and a second loop portion, contacted therewith, of a second electrically conductive material, said first and said second materials having different contact potentials in the contact series. The contact point is appropriately located in the vicinity of a preferably provided overlapping portion, i.e. is directly subject to the radiant energy of the radiant heater. An advantage of this variant is its simple construction, because apart from the sensor loop no additional elements are required. The thermoelectric voltage can simply be tapped at appropriate points of the resonant circuit embracing the sensor loop.

For forming a thermocouple it is also possible to provide at least one preferably filamentary material portion, which is made from an electrically conductive material with an electric contact potential different from the loop portion material and which is electrically conductively connected to the loop portion in the vicinity of a contact point and is more particularly welded thereto. In this case one thermocouple side is formed by the loop portion, whereas the separate material portion fitted thereto forms the other side. The thermoelectric voltage is then tappable between the end of the material portion and one end of the sensor loop. For forming a thermocouple with two contact areas, it is also possible to provide two preferably filamentary material portions of electrically conductive material, which are electrically conductively connected in spaced manner with a loop portion in the vicinity of the contact points and are more particularly welded, the two material portions being made from materials with different electric contact potentials. In this case a thermoelectric voltage can be tapped at the free ends of both material portions and said voltage is essentially only determined by the different contact potentials of these materials. There is here a substantially complete freedom in the choice of material for the loop portion.

The latter variants with separate material portions fitted and in particular welded to the sensor loop with the formation of contact points offer the advantage that the sensor loop can have a very simple construction. By fitting suitable, e.g. filamentary material portions, e.g. by spot welding, it is also possible to reequip in simple inexpensive manner for the formation of temperature detection devices according to the invention existing systems with pot detection sensors.

It is also possible for the device for detecting and evaluating temperature signals to be constructed so as to emit at least one measurement pulse and to have a device for determining the transit time of said pulse through the sensor loop or through a separate measuring element, more particularly carried by and associated with the sensor loop. Use is made of the fact here that the transit time of a measurement pulse, e.g. through the sensor loop, is generally extended by the heating of the sensor. This transit time change can be used as a measure for the temperature. It is also possible to use the presence of the pot detection sensor in such a way that a portion located in the vicinity of the heating zone uses the same as a heat absorption portion, dissipates the absorbed heat along the sensor loop and at another point, e.g. in the vicinity of an insulating edge or outside the heating zone utilizes the same for temperature detection purposes. In this case the temperature sensor can e.g. have at least one temperature switch in thermally conductive connection with the portion, particularly the overlapping portion and which is fitted to the sensor loop for the temperature-dependent short-circuiting of at least one turn of the sensor loop. The temperature switch can e.g. be constructed as a snap action switch in the manner of a bimetallic switch. The temperature-dependent switching of the temperature switch and the associated short-circuit or elimination of a short-circuit of sensor loop turns leads to a temperature-dependent inductance jump, which can be readily evaluated with the evaluation electronics of the pot detection system. Such an induction jump dependent on the switching temperature of the temperature switch can e.g. be used in the framework of a temperature monitor (overheating protection) and/or in the framework of a hot indication.

It is also possible that the sensor loop or a suitable portion thereof is constructed as a support for at least one electrically active element of a temperature sensor. The support function more particularly means that the portion maintains the electrically active element of the temperature sensor in a position favourable for temperature detection, e.g. spaced from the insulating edge of the heating zone above the radiant heating elements. The sensor loop can exclusively have this support function or can additionally be used for some other, e.g. electrical function.

Thus, it is in particular possible for the sensor loop to have a preferably tubular hollow body made from thermally stable, electrically conductive material and for there to be in an inner area of the hollow body at least one electrically active, preferably filamentary inner element of the temperature sensor. The hollow body can serve not only as a support for the inner element, but also at the same time as a protection thereof against mechanical damage and/or thermally caused deterioration to characteristics. For example, the inner element can be an element of a thermocouple, e.g. a leg thereof, or also a complete thermocouple (with two elements connected to a contact point). The wire material for forming a thermocouple can in the case of a supporting and protecting envelope be much thinner and therefore less expensive than in the case of an optionally self-supporting and/or exposed thermocouple. The preferably inherently rigid or self-supporting hollow body, e.g. an iron-nickel-chrome alloy tube can itself be an electrically active part of a thermocouple, in that the other partial element is appropriately contacted with the hollow body e.g. by spot welding. The inner element can also be made from an electrically conductive material portion with a high positive or negative temperature coefficient of the electrical resistance in order to utilize the aforementioned resistance measurement for temperature detection purposes. Except for the area of optionally desired contact points, the inner element and hollow body are appropriately insulated against one another, in that e.g. the inner element is surrounded by a ceramic insulating material, which partly or entirely fills the interior of the hollow body.

If the temperature detection device according to the invention is used for continuous temperature detection purposes, it is e.g. possible to replace conventional rod regulators or the like. It is also possible to control a hot indicating device as a function of the real hotplate, particularly glass ceramic plate temperature and optionally to indicate the same. In general numerous functions can be implemented where the detection of a current hotplate temperature is important. For example, no longer need fixed settings of a setting regulator be associated with cooking stages of a cooking implement and instead, as in so-called automatic hotplates, they can be associated with the current temperature detected by the temperature detection device and to which they are set. A temperature regulating means can also be designed in such a way as to automatically control the function of a parboiling surge.

Any suitable sensor loop of a pot detection device can be utilized for the construction of temperature detection devices according to the invention. A preferred embodiment in which the sensor loop only has a single turn of dimensionally stable, self-supporting and electrically conductive material will be described in greater detail in conjunction with the embodiments. It can be in the form of a solid, thick wire or in the form of a tube, whose interior can be used for receiving elements of the temperature detection device. As a result of an advantageous arrangement of the sensor loop directly below the hot point with a significant spacing from the radiant elements it can be ensured that the prevailing temperature on the sensor loop corresponds with respect to its path and absolute amount to that of the hotplate.

The invention also relates to the use of at least one portion of a sensor loop of an inductive sensor for detecting the positioning of a cooking vessel on a hotplate, particularly glass ceramic plate covering a radiant heater, as the functional part of a temperature sensor for determining the temperature of the hotplate. As stated, the portion or the entire sensor loop can be electrically active or, alternatively or additionally, can serve as a support for at least one electrically active element of a temperature sensor. The particular advantage is that the sensor loop or portion can be positioned particularly favourably for a temperature detection, more particularly close to the underside of a glass ceramic plate and/or that if appropriate it is possible to obviate the need for separate elements for creating a temperature sensor, because the sensor loop fulfils a double function both within the framework of an electrical temperature sensor and within that of an inductive sensor for pot detection.

Apart from the claims, these and further features can be gathered from the description and drawings and the individual features, both singly or in the form of subcombinations, can be implemented in an embodiment of the invention and in other fields and can represent advantageous, independently protectable constructions.

The invention is described hereinafter relative to embodiments and the attached drawings, wherein show:

FIG. 1 A central section through a radiant heater under a glass ceramic plate with intimated cooking vessels.

Figure 2:
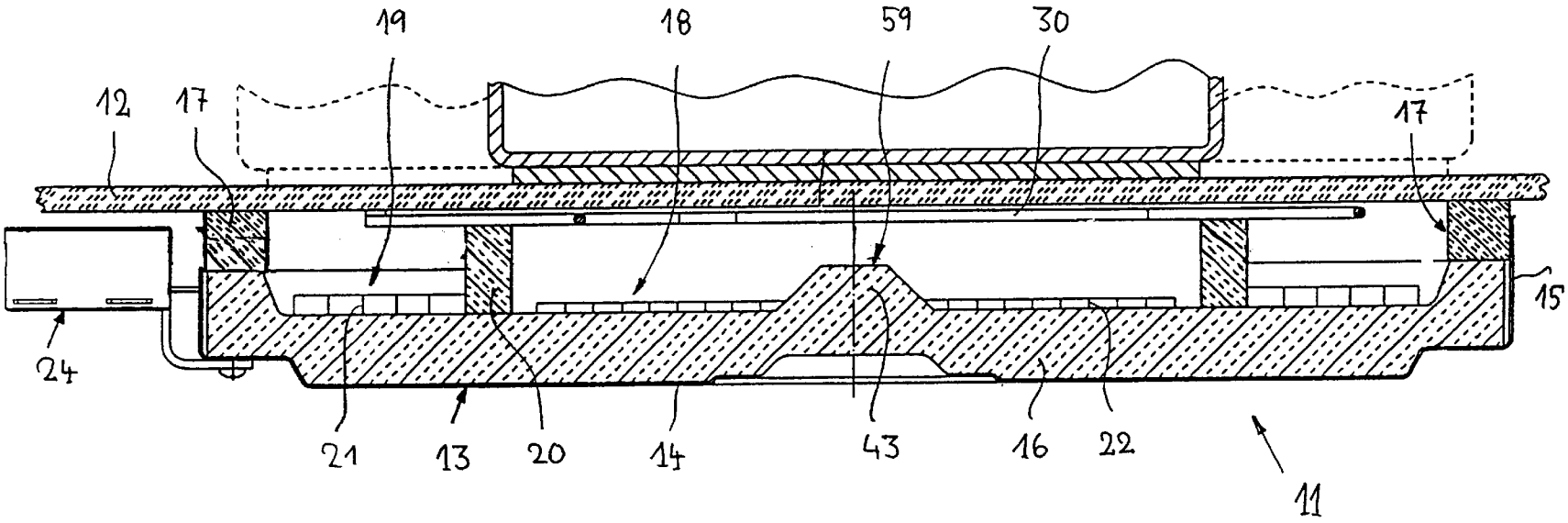

FIG. 2 A plan view of the radiant heater of FIG. 1, two thermocouples being housed within a sensor loop formed by a tube.

Figure 3:
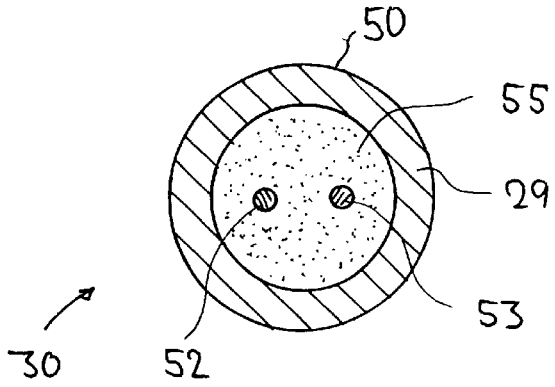

FIG. 3 A diagrammatic section along line III—III in FIG. 1.

FIGS. 4 to 7 Diagrammatic representations of other embodiments constructed for temperature measurement by means of thermoelectric voltage.

Figure 8:
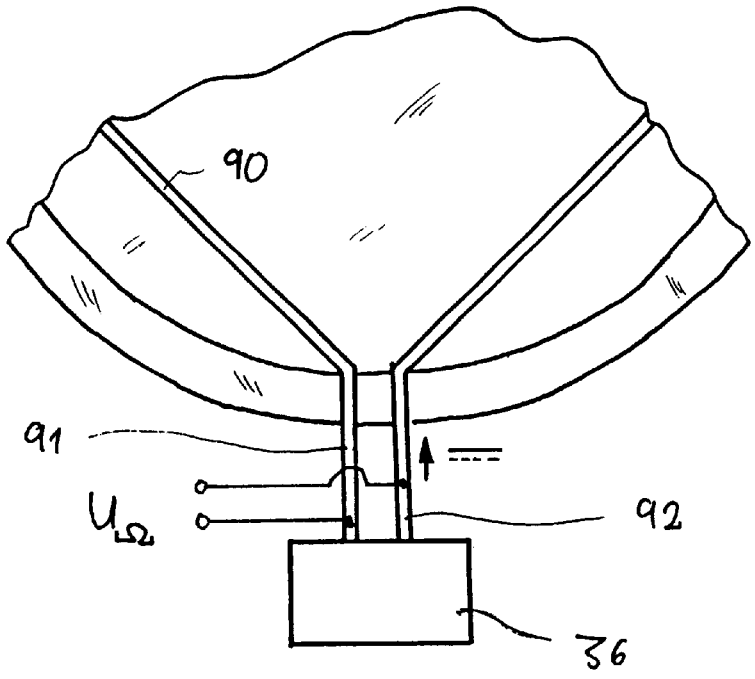

FIG. 8 A diagrammatic plan view of an embodiment constructed for temperature measurement by sensor loop resistance determination.

Figure 9:
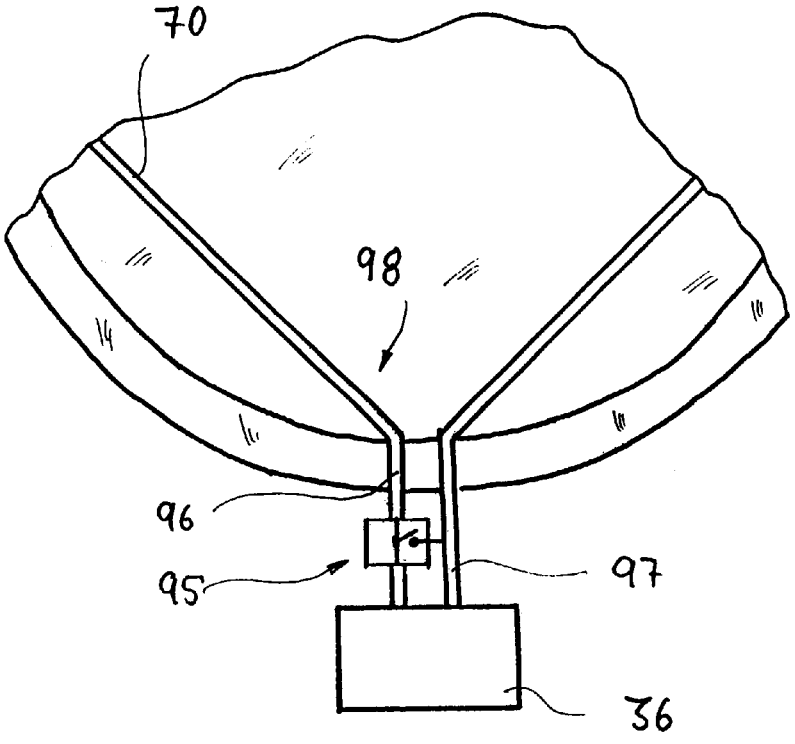

FIG. 9 An embodiment with a thermal switch for short-circuiting the sensor loop.

FIGS. 1 and 2 show an electric radiant heater 11 positioned under a glass ceramic plate 12 of an electric hot or some other radiant cooker. It has a flat sheet metal dish 13, whose base 14 and edge 15 have a base coating 16 and a rim 17 of electrically and thermally insulating, heat-resistant insulating material. It is preferably a microporous fumed silica aerogel moulded or pressed from bulk material. For improved mechanical strength reasons, the outer rim 17 is separately manufactured and is formed from a moulded or wet-shaped and then subsequently dried unit with ceramic fibres, binders, etc.

The sheet metal edge 15 does not extend entirely up to the glass ceramic plate 12, but instead to the insulating rim 17, which is pressed from below onto the glass ceramic plate, in that the heater 11 is pressed upwards by a not shown pressing spring.

The radiant heater has two heating zones 18, 19 concentric to one another and which are mutually defined by a partition 20, but which does not extend up to the glass ceramic plate.

In both heating zones 18, 19 are provided electrical heating elements 21 in the form of thin, wavy strips, which are arranged upright on the surface 22 of the insulator 16 and which in the embodiment shown are anchored in the insulator with feet shaped on the underside thereof and have a spade shape as a result of the corrugation of the strip. In other embodiments the corrugated strip can also be bounded in straight-edged manner and free from feet. For anchoring purposes the top of the insulator can have appropriate profilings with raised sections and depressions. The heating conductor strip can engage in the raised sections for anchoring purposes. The heating conductors uniformly cover the two heating zones 18, 19 with the exception of an unheated central zone 59, in which is located an upwardly directed projection 43 of the insulating base 16.

With the radiant heater is associated an active sensor for detecting the positioning of a cooking vessel on the glass ceramic plate 12 covering the heater 11. The sensor is part of a resonant circuit of a control 31 operating inductively by resonant circuit tuning and essentially comprises a sensor loop 30 forming an inductance of the resonant circuit 32 and which is excited with a relatively high frequency of e.g. 1 to 5 MHz. On setting down a cooking vessel there is a change to the loading of the sensor loop 30 and consequently the frequency of the resonant circuit 32. This is evaluated in the control means 31 and as a function thereof mechanical or electronic switches 33, 33*a* are controlled in the control means and switch on the heating zones 18, 19.

For setting the released power is provided a power control device 34 (often known as a power controller), which can be adjusted to a given power by means of a knob 35. It is also possible to have a temperature regulator. The regulation or control is usually a cyclic power release, i.e. a stopping regulating or control. The power control device 34 can be constructed thermomechanically, e.g. in bimetallic switch form, or preferably as an electronic component, which can optionally be integrated into the control 31. To keep away interference from the resonant circuit 32, the line between the sensor loop 30 and the remaining elements of the resonant circuit should be kept as short as possible. A shielding of the lines is also possible. Optionally the control component 36 containing the actual cooking vessel detection could be positioned separately from the remaining heater control and spatially close to the radiant heater 11.

The single-turn sensor loop essentially comprises a relatively thick tube with an external diameter between approximately 2 and approximately 4 mm. The tubular jacket 29 is made from a thermally stable, non-magnetizable material. It can e.g. be a high-alloyed steel, such as an iron-chrome-nickel alloy. Suitable materials are e.g. a steel with the material number 1.4876 or a heating conductor material with the material number 2.4869. The relatively solid jacket material ensures a thermal stability and resistance to scaling of the sensor loop. The relatively thick construction, particularly in conjunction with the cylindrical tube shape, creates a very rigid construction of the sensor loop 30 and ensures that even under high thermal stresses a sinking onto the heating elements 21 need not be expected. Another reason why this risk is so small is that the sensor loop 30, as can be seen in FIG. 1, is positioned directly below the glass ceramic plate 12 or at a very limited distance therefrom and compared therewith is a long way from the heating elements.

In the embodiment shown in FIG. 2 the sensor loop 30 forms a single-turn coil with outer circumferential portions 37 passing over the outer heating zone 19, but with a relatively large radial spacing from the outer rim 17 and once again in radially spaced manner from the partition 20, inner circumferential portions 38 passing over the heating zone 18. These circumferential portions are arcuate portions of different diameter interconnected by connecting portions 39. Admittedly said connecting portions run substantially radially, but are inclined in such a way that the sum of the angles of the outer and inner circumferential portions 37, 38 exceeds 360ø. The plan view of the sensor loop 30 reveals the basis shape of a three-leaved clover with a relatively large central area almost forming a complete circle and three lateral "leaves" in the form of a triangular sector or omega. As a function of the size and control requirements more circumferential portion sectors can be provided. On one of the circumferential portion sectors 40 are provided connections 41 in the form of outwardly directed, parallel portions of the loop material.

The complete sensor loop 30 is flat and, as a result of the relatively thick material, self-supporting and dimensionally stable. In the present embodiment it is located in the vicinity of the connections 41 in flat depressions of the insulator outer rim 17 and is also supported with its connecting portions 39 on the partition 20, which do not extend completely up to the glass ceramic plate. Thus, the sensor loop engages with or is at a limited distance from the underside of the glass ceramic plate 12 and has a safety clearance above the heating elements 21.

It can be seen that the sensor loop, with the exception of the connecting portions 41 and the short portions crossing the outer rim 14 or the partition 20, overlaps with a significant part of its length the radiant heater areas provided with heating elements 21. These overlapping portions are in visible connection or in direct radiant area of the heating elements, so that the thermal coupling between the overlapping portions and the heating elements 21 is particularly good. As a result of the immediate proximity to the glass ceramic plate 12, it is ensured that the temperature of the overlapping portions only differs slightly from the glass ceramic plate temperature. These circumstances can be utilized for a precise temperature detection.

In the temperature detection device for the radiant heater 11, the sensor loop 30 with a portion 50 serves as a functional component of a temperature sensor 51, which emits temperature signals in the form of a thermoelectric voltage. The temperature sensor 51 is constructed in the manner of a jacket thermocouple, in which the portion 50 of the sensor loop extending from the connecting area 41 to the next inner circumferential portion 38, forms a protective envelope around the electrically active components of the thermocouple. As electrically active components are provided two wires 52, 53 made from different, high-melting metals, whose ends in the area of the portion 38 are welded together accompanied by the formation of a contact point 54. Within the jacket 29 the wires are surrounded by insulating material 55, which electrically insulate and mechanically hold the wires 52, 53 against one another and against the conductor material of the jacket 29. The ends opposite to the contact point 54 are connected to the electric contacts of a temperature monitor 24. Due to the fact that the thermocouple wires 52, 53 are protected by the jacket 29 and are carried by the latter with the aid of the insulating material 55, the wires can be very thin, which in the case of expensive wire material such as e.g. platinum for wire 52 and platinum-rhodium for wire 53 leads to cost economies. Other material combinations, e.g. nickel/nickel-chromium are possible.

With the aid of the thermocouple 51 a continuous temperature signal in the form of a thermoelectric voltage UT can be generated, from which the temperature of the contact point 54 can be derived and consequently essentially the temperature of the inner heating zone 18 in the immediate vicinity of the glass ceramic plate can be determined. In the same way it is possible with the aid of a thermocouple 56, whose contact point 57 is in the area of the outer heating zone 19, to determine the temperature thereof, in that a corresponding thermoelectric voltage signal UT is supplied to the temperature monitor 24. The at least one temperature signal in the form of a thermoelectric voltage can be evaluated by a suitable, here not explained electronic signal processing device, which can e.g. be located within a casing of the temperature monitor 24, in order to e.g. disconnect the heating system of a zone on exceeding a predetermined temperature or on exceeding a predetermined low temperature, e.g. of approximately 70øC, to activate a hot indication for the corresponding temperature zone. It is possible to use the continuously present temperature signal as an input signal of an electronic temperature control, in order to adjust the temperature of the radiant heater, optionally in zone-specific manner to a presettable value.

With the aid of FIGS. 4 to 7 other possibilities are explained using at least one portion of a sensor loop belonging to a pot detection device for building up a temperature sensor which, in the case of simple construction, permits a reliable temperature measurement. Whereas in the embodiment illustrated by FIGS. 1 to 3 the tubular pot detection sensor 30 essentially fulfils a supporting and protective function with regards to temperature measurement, in the embodiments described hereinafter at least one portion of the sensor loop is an electrically active element of an electrical temperature sensor, whose signals can be evaluated with electronic means.

Figure 4:
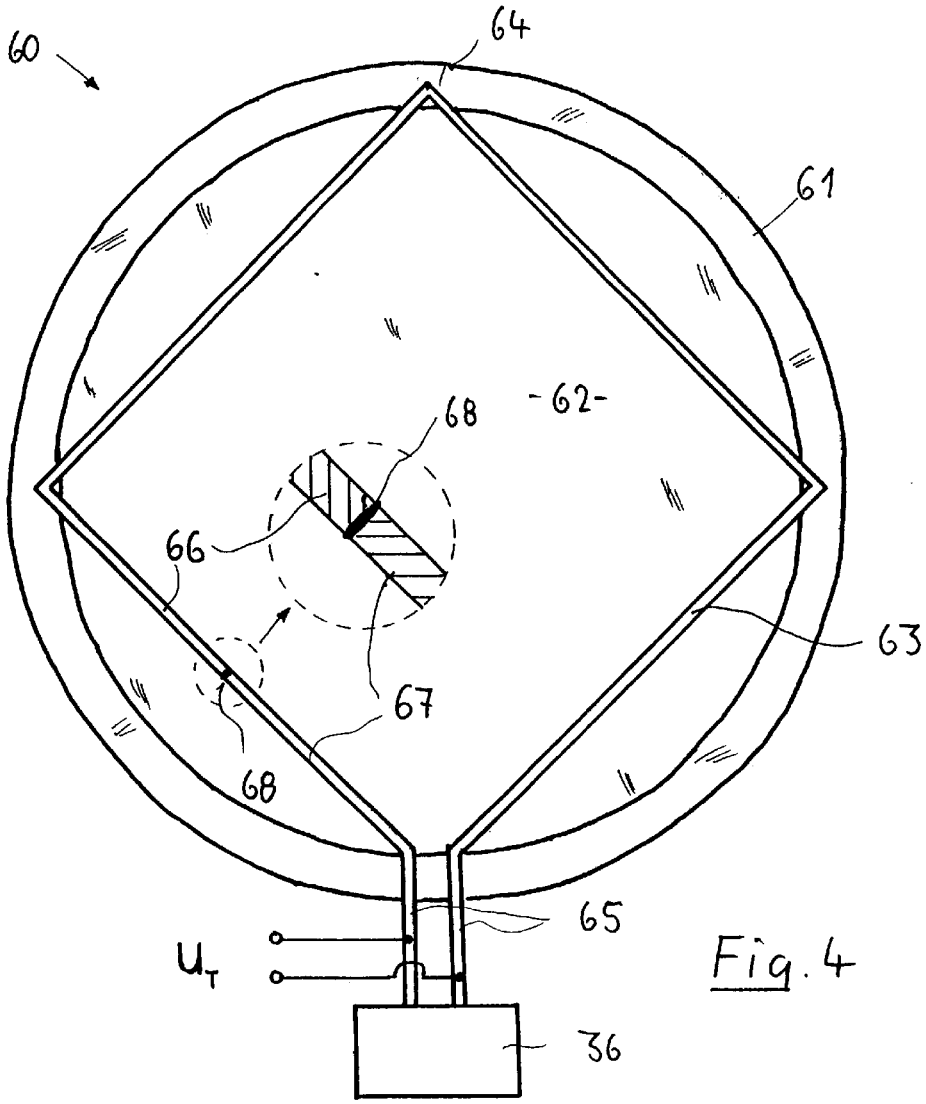

In the embodiment according to FIG. 4 the radiant heater 60 is constructed as a single-circuit heater with a circular heating zone 62 surrounded by an insulating edge 61. The sensor loop 63 is shaped like a square with corners 64 supported on the edge 61 and in the vicinity of one of the corners connecting portions 65 lead to the component 36 in which is housed the pot detection electronics. The sensor loop 63 comprises a relatively thick, solid circular wire with a diameter between 2 and 4 mm and as a result of this construction is self-supporting and dimensionally stable. In this embodiment the sensor loop 63 is constructed from two conductor materials having different electrical contact potentials. A nickel material portion 66 extending over 3<< side lengths of the sensor loop and a correspondingly shorter nickel-chrome alloy portion 67 abut with one another in the vicinity of a weld-contact point 68. Spaced from the edge 61, said contact point is located freely above the not shown heating elements directly below the also not shown glass ceramic plate and consequently forms an optimum-positioned measuring point for the radiant heater temperature detection. The temperature signal in the form of a thermoelectric voltage UT can be tapped on the sensor loop connecting portion 65 and supplied to an electronic signal evaluating device.

Figure 5:
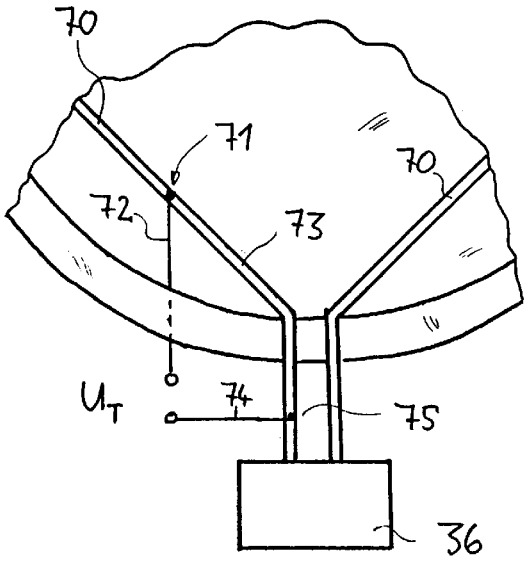

The sensor loop 70 in the case of the embodiment only partially shown in FIG. 5 is, with regards shape, dimensions and connections to the pot detection electronics 36, substantially the same as in FIG. 4. However, here the sensor loop 70 is made from a one-piece, through wire portion of thermally stable, high-alloy steel, e.g. iron-chromium-nickel alloy (e.g. Chronifer III E). In the vicinity of a contact point 71 located in an overlapping portion, to the sensor loop 70 is welded a wire 72 of a material, e.g. nickel with a different electric contact potential. In the case of the thus formed thermocouple for determining the temperature in the area of the contact point 71, the wire 72 forms one side of the thermocouple, whereas the other, electrically active side is formed by the sensor loop portion 73, which extends from the outer connections of the sensor loop to the contact point 71. Outside the heating zone a wire 74 is welded to the portion 73 and is appropriately made from the same material as wire 72. A voltage signal can be tapped as a thermoelectric voltage UT between the wires 72, 74 and corresponds to the temperature difference between the hot weld point 71 and the outer, cold contact point 75.

Figure 6:
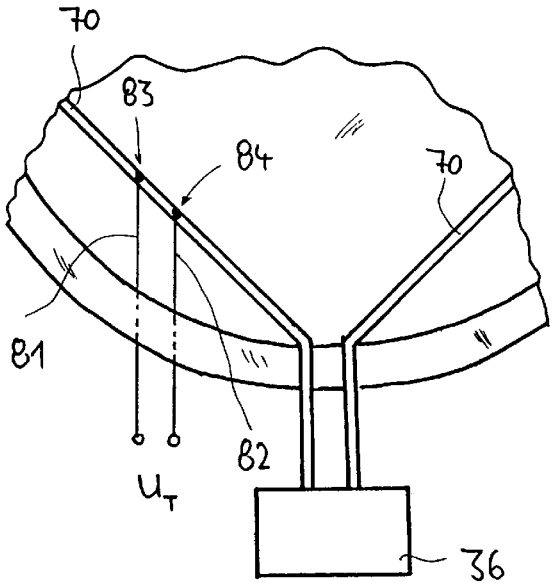

In the embodiment of FIG. 6 the wire loop has an identical construction to the sensor loop 70 of FIG. 5 and is connected to the pot detection evaluation electronics. For forming a thermocouple there are two wires 81, 82 which, accompanied by the formation of contact points 83, 84 having a limited mutual spacing in an overlapping portion of the sensor loop, are welded to the latter and passed through the insulating edge outwards to the evaluation electronics of the temperature detection device. The wires 81, 82 are made from different materials with respect to the electric contact potential, e.g. of nickel or nickel-chrome. As the contact points 83, 84 are close together and consequently have essentially the same temperature, as the evaluatable thermoelectric voltage UT the same voltage is obtained as with a Ni—Cr—Ni thermocouple, whose contact point is in the vicinity of the contact points 83, 84. By welding to the sensor loop this ensures a favourable positioning of the measuring area 83, 84 close to the glass ceramic plate in the vicinity of the heating zone and also the thermocouple wire ends projecting into the heating zone are carried by the sensor loop, which forms with the portion located between the contact points 83, 84 an electrically active element of the temperature sensor.

Figure 7:
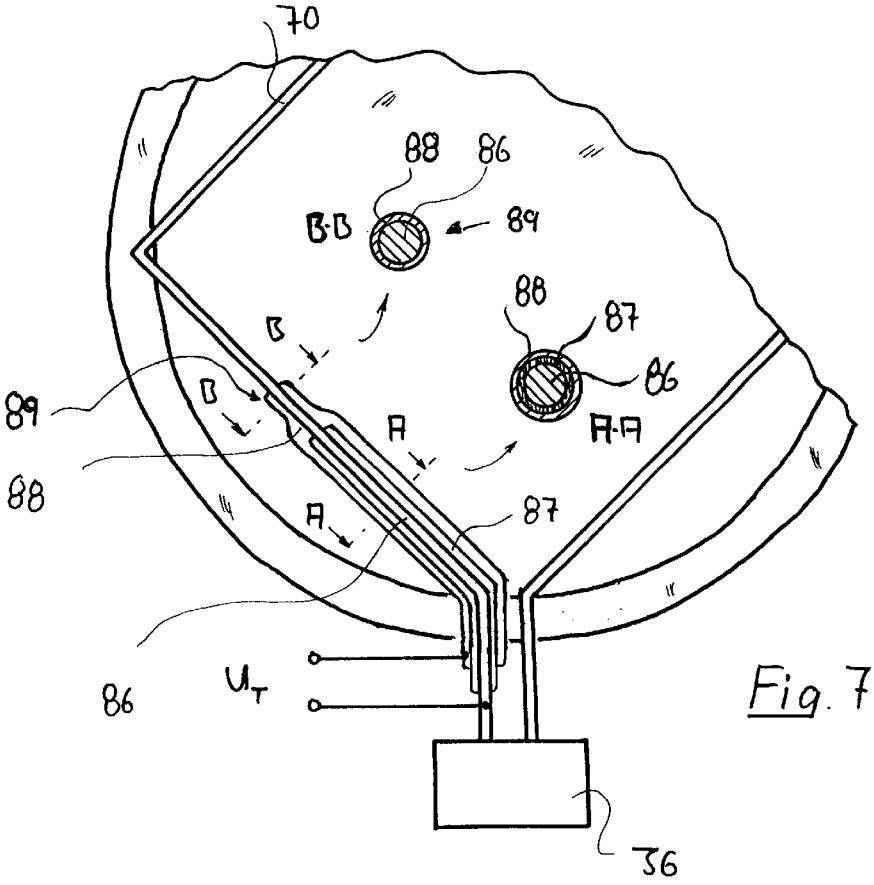

With regards to material, shape and arrangement, the sensor loop 70 of the embodiment according to FIG. 7 essentially corresponds to that of FIG. 5. To the left-hand leg of the sensor loop in the drawing is applied to a portion 86 passing through the insulating edge, an electrically insulating coating 87, which surrounds the sensor wire and which is e.g. of ceramic material. It is enveloped by an outer coating 88 of electrically conductive material also preferably applied using a thick-film process (section A—A). In the loop direction its length is greater than that of the insulating envelope, so that in a contact area 89 (section B—B), the material of the metallic sleeve 88 is in direct contact with the material of the loop 70. As the conductor materials of the sensor loop 70 and outer sleeve 88 have different electric contact potentials, between them and outside the heating zone can be tapped a thermoelectric voltage UT representing the temperature in the contact area 89 and which is supplied to the electronic signal processing device of the temperature detection device.

The embodiment according to FIG. 8 uses a measurement of the electrical resistance along the sensor loop 90 overlapping the heating zone for producing a temperature signal. The approximately 1 m long, and approximately 2.5 mm diameter wire loop of iron-chrome-nickel alloy is for this purpose subject to the action of a constant measuring current of approximately 0.5 ampere using a not shown direct current source, which is e.g. housed in component 36. The measuring voltage dropping over the sensor loop and which can e.g. be tapped at the connections or terminals 91, 92 is dependent on the temperature-dependent resistance of the material, which in the present case is at ambient temperature approximately 0.21 ohm and at 600° C. approximately 0.25 ohm. This resistance change of approximately 0.04 ohm in this temperature range or the corresponding voltage change is utilized for temperature measurement purposes. A resistance thermometer could also be created in that the e.g. tubular sensor loop shown in FIGS. 1 to 3 is traversed by an insulated resistance wire.

In the embodiment according to FIG. 9 to the sensor loop 70 with the characteristics described, e.g. in conjunction with FIG. 5, outside the insulating edge and on a connecting portion 96, is fixed a thermomechanical switch 95 in the form of a bimetallic switch with good thermal contact with the sensor loop. The switch is so connected and designed that in a closed switch position the sensor loop 70 is short-circuited by electrical connection of the connecting portions 96, 97, whereas in an open switch position these connections are separated from one another. When the radiant heater is in operation the portion 98 of the sensor loop located at a limited distance from the thermal switch within the insulating edge serves as a heat absorption element from which the heat is passed through this sensor loop portion to the outside to the thermal switch 95 and which is correspondingly heated. At a switching temperature predeterminable by the switch design the switch short-circuits the sensor loop. Thus, the frequency measurement of the pot detection circuit 36 will only determine the cable inductances, but not the higher inductance of the square sensor loop. This leads to a rapid frequency change at the switching temperature, which can be evaluated using the evaluation software. Such a switch switching close to a switching temperature can e.g. replace conventional rod regulators with corresponding temperature monitors. However, the other embodiments permit a continuous temperature detection, so that said embodiments can be usefully utilized in conjunction with temperature regulating means.

What is claimed is:

1. A temperature detection device for an electric radiant heater associated with an active sensor, wherein said active sensor detects the positioning of a cooking vessel on a hotplate covering the radiant heater, said device comprising:

said active sensor having at least one sensor loop with electrically conductive material positioned in the vicinity of at least one heating zone, the heating zone heatable by electric radiant heating elements;

a temperature signal-emitting temperature sensor;

a support for at least one electrically active element of said temperature sensor, wherein said support is constructed of at least one portion of said sensor loop;

wherein at least one portion of said sensor loop comprises a functional component of said temperature sensor; and wherein said temperature sensor is a thermocouple.

2. The temperature detection device according to claim 1, wherein said sensor loop at least partly overlaps with at least one overlapping portion of said heating zone.

3. The temperature detection device according to claim 2, wherein said portion of said sensor loop used as a functional part of said temperature detection device is located in the vicinity of said overlapping portion.

4. The temperature detection device according to claim 1, further comprising an electronic device for evaluating electric temperature signals.

5. The temperature detection device according to claim 1, wherein said sensor loop is formed by a hollow body of a thermally stable, electrically conductive material; and wherein at least one electrically active inner element is located in an inner area of said hollow body of said temperature sensor.

6. The temperature detection device according to claim 1, wherein said sensor loop only has a single turn.

7. The temperature detection device according to claim 1, wherein said sensor loop comprises a dimensionally stable, self-supporting, electrically conductive material.

8. The temperature detection device according to claim 7, wherein said sensor loop comprises a solid, thick wire or a tube.

9. An electric radiant heater associated with an active sensor for detecting the positioning of a cooking vessel on a hotplate covering said radiant heater, said radiant heater comprising:

said active sensor having at least one sensor loop with electrically conductive material positioned in the vicinity of at least one heating zone of said radiant heater, said heating zone heatable by electric radiant elements;

a temperature signal-emitting temperature sensor;

a support for at least one electrically active element of said temperature sensor, wherein said support is constructed of at least one portion of said sensor loop;

wherein at least one portion of said sensor loop comprises a functional component of said temperature sensor; and wherein said temperature sensor is a thermocouple.

10. A temperature detection device for an electric radiant heater associated with an active sensor for detecting the positioning of a cooking vessel on a hotplate covering the radiant heater, said active sensor comprising:

at least one sensor loop with electrically conductive material positioned in the vicinity of at least one heating zone, said heating zone heatable by electric radiant heating elements;

at least one portion of said sensor loop forming a functional component of a temperature signal-emitting temperature sensor of said temperature detection device;

wherein said sensor loop is formed by a hollow body of a thermally stable, electrically conductive material; and wherein at least one electrically active inner element of a temperature sensor is located in an inner area of said hollow body.

11. The temperature detection device according to claim 10, wherein said sensor loop at least partly overlaps with at least one overlapping portion of said heating zone.

12. The temperature detection device according to claim 11, wherein said portion of said sensor loop used as a functional part of said temperature detection device is located in the vicinity of said overlapping portion.

13. The temperature detection device according to claim 10, wherein at least one inner element is an element of a thermocouple.

14. The temperature detection device according to claim 10, wherein at least one inner element is part of a resistance thermometer through which a current flows.

15. The temperature detection device according to claim 10, wherein said sensor loop only has a single turn.

16. The temperature detection device according to claim 10, wherein said sensor loop comprises a dimensionally stable, self-supporting, electrically conductive material.

17. The temperature detection device according to claim 16, wherein said sensor loop comprises a solid, thick wire or a tube.

18. An electric radiant heater, associated with an active sensor for detecting the positioning of a cooking vessel on a hotplate covering said radiant heater, said radiant heater comprising:

at least one sensor loop with electrically conductive material located in the vicinity of at least one heating zone of said radiant heater, said heating zone heatable by electric radiant elements, at least one portion of said sensor loop forming a functional component of a temperature signal-emitting temperature sensor of a temperature detection device;

wherein said sensor loop is formed by a hollow body of a thermally stable, electrically conductive material; and wherein at least one electrically active inner element of a temperature sensor is located in an inner area of said hollow body.

19. A temperature detection device for an electric radiant heater associated with an active sensor for detecting the positioning of a cooking vessel on a hotplate covering the radiant heater, said active sensor comprising:

at least one sensor loop with electrically conductive material positioned in the vicinity of at least one heating zone heatable by electric radiant heating elements;

at least one portion of said sensor loop forming a functional component of a temperature signal-emitting temperature sensor of said temperature detection device;

wherein a device for evaluating temperature signals is provided, which is constructed for the determination and evaluation of thermally caused changes to a resistance element carried by said sensor loop.

20. The temperature detection device according to claim 19, wherein said sensor loop at least partly overlaps with at least one overlapping portion of said heating zone.

21. The temperature detection device according to claim 20, wherein said portion of said sensor loop used as a functional part of said temperature detection device is located in the vicinity of said overlapping portion.

22. The temperature detection device according to claim 19, wherein said sensor loop is formed by a hollow body of a thermally stable, electrically conductive material and wherein in an inner area of said hollow body is located at least one electrically active inner element of a temperature sensor.

23. A temperature detection device for an electric radiant heater associated with an active sensor for detecting the positioning of a cooking vessel on a hotplate covering the radiant heater, said active sensor comprising:

at least one sensor loop with electrically conductive material positioned in the vicinity of at least one heating zone heatable by electric radiant heating elements;

at least one portion of said sensor loop forming a functional component of a temperature signal-emitting temperature sensor of said temperature detection device;

wherein said sensor loop is constructed with at least one portion as a support for at least one electrically active element of a temperature sensor.

24. The temperature detection device according to claim 23, wherein said temperature sensor is a thermocouple.

25. The temperature detection device according to claim 23, wherein said sensor loop at least partly overlaps with at least one overlapping portion of said heating zone.

26. The temperature detection device according to claim 25, wherein said portion of said sensor loop used as a functional part of said temperature detection device is located in the vicinity of said overlapping portion.

27. The temperature detection device according to claim 23, wherein said sensor loop is formed by a hollow body of a thermally stable, electrically conductive material and wherein in an inner area of said hollow body is located at least one electrically active inner element of a temperature sensor.

28. The temperature detection device according to claim 23, wherein at least one inner element is part of a resistance thermometer through which a current flows.

29. The temperature detection device according to claim 23, wherein said sensor loop only has a single turn.

30. The temperature detection device according to claim 23, wherein said sensor loop comprises a dimensionally stable, self-supporting, electrically conductive material.

* * * * *